US006173932B1

(12) United States Patent
Poradzisz

(10) Patent No.: US 6,173,932 B1
(45) Date of Patent: Jan. 16, 2001

(54) MOUNTING DEVICE FOR MOUNTING A HAND TYING DEVICE TO A BALE OF COMPRESSED MATERIAL

(75) Inventor: James Poradzisz, Pomona, CA (US)

(73) Assignee: L&P Property Management Company, South Gate, CA (US)

( * ) Notice: Under 35 U.S.C. 154(b), the term of this patent shall be extended for 0 days.

(21) Appl. No.: 09/090,290

(22) Filed: Jun. 4, 1998

(51) Int. Cl.[7] ..... B65B 13/18; A47B 96/06
(52) U.S. Cl. ..... 248/231.41; 100/11
(58) Field of Search ..... 248/231.41, 188.5, 248/316.4

(56) References Cited

U.S. PATENT DOCUMENTS

| | | | | |
|---|---|---|---|---|
| 373,472 | | 11/1887 | Moser . | |
| 376,216 | * | 1/1888 | Stillman | 182/164 |
| 399,856 | | 3/1889 | Eisenhart . | |
| 664,326 | | 12/1900 | Kintzing . | |
| 743,520 | | 11/1903 | Kennedy . | |
| 875,654 | | 12/1907 | Christensen . | |
| 985,023 | | 2/1911 | Fry . | |
| 1,177,557 | * | 3/1916 | White | 182/164 |
| 1,507,376 | | 9/1924 | Hintz . | |
| 1,603,638 | * | 10/1926 | Phillips | 182/163 |
| 2,061,937 | * | 11/1936 | Fay | 248/316.4 |
| 2,318,943 | * | 5/1943 | Holmes | 182/163 |
| 2,796,662 | | 6/1957 | Saum . | |
| 2,868,239 | | 1/1959 | Ellis . | |
| 2,986,366 | * | 5/1961 | Wesson | 248/285 |
| 3,030,060 | * | 4/1962 | Breuer | 248/265 |
| 3,149,559 | | 9/1964 | Lynch . | |
| 3,201,075 | * | 8/1965 | Sievers | 248/147 |
| 3,490,726 | * | 1/1970 | Mills | 248/316.4 |
| 3,541,828 | | 11/1970 | Norman . | |
| 3,794,086 | | 2/1974 | Hall et al. . | |
| 4,010,925 | * | 3/1977 | Garchinsky | 248/295 |
| 4,120,238 | | 10/1978 | Schafer et al. . | |
| 4,155,296 | | 5/1979 | Schafer . | |
| 4,164,176 | | 8/1979 | Brouse et al. . | |
| 4,167,902 | | 9/1979 | Bister et al. . | |
| 4,177,724 | | 12/1979 | Johnson, III et al. . | |
| 4,459,904 | | 7/1984 | Probst et al. . | |
| 4,572,554 | | 2/1986 | Janssen et al. . | |
| 4,577,554 | | 3/1986 | Brouse . | |
| 4,751,982 | * | 6/1988 | Wolfe | 182/164 |
| 4,895,336 | | 1/1990 | Lieberman . | |
| 4,944,434 | | 7/1990 | Hamilton . | |
| 5,211,260 | * | 5/1993 | Toycen | 182/164 |
| 5,279,336 | | 1/1994 | Kusakari et al. . | |
| 5,335,754 | * | 8/1994 | Gibson | 248/188.5 |
| 5,636,819 | * | 6/1997 | Kettlestrings | 248/216.1 |
| 5,816,462 | * | 10/1998 | Brantley | 224/570 |
| 5,913,382 | * | 6/1999 | Martin | 248/188.5 |

FOREIGN PATENT DOCUMENTS

| | | | | |
|---|---|---|---|---|
| 717865 | * | 2/1932 | (FR) | 248/188.5 |

* cited by examiner

*Primary Examiner*—Anita M. King
(74) *Attorney, Agent, or Firm*—Wood, Herron & Evans LLP

(57) ABSTRACT

A mounting device for use with a hand tying device to tie a bale of compressed material comprises a pair of elongated members positioned generally parallel to each other to form a generally planar body and legs extending from an end of the body, generally perpendicular to said body. Mounting feet depend from the legs and are configured to engage a generally horizontal surface of a bale to secure the body along a vertical surface of the bale. At least one standoff element extends from another end of the body and is configured for coupling to a hand tying device and orienting the hand tying device against the vertical surface of the bale when the body is secured to the bale.

8 Claims, 4 Drawing Sheets

MOUNTING DEVICE FOR MOUNTING A HAND TYING DEVICE TO A BALE OF COMPRESSED MATERIAL

FIELD OF THE INVENTION

The present invention relates to tying or binding bales of compressed material. Specifically, the invention relates to an assembly for mounting a hand tying device to a bale of compressed material for assistance in tying wires or other binding devices wrapped around such a bale.

BACKGROUND OF THE INVENTION

Various types of bulk materials are shipped, stored, and otherwise processed and distributed in the form of compressed bales. For example, recyclable paper products are processed into compressed bales so that the paper may be more easily handled, and a greater amount of such products may be stored and shipped in a smaller space than would be possible with loose bulk material. As is appreciated, bales are substantially easier and more efficient to handle than the loose bulk material.

To form a bale, it is generally known to wrap such bales of compressible material with wire or other elongated binding devices to keep the bales in a compressed form, such as for shipping and storage. Wire is often most preferable as a binding material for its low cost and the ease with which it is handled. To bind a bale, the wire is wrapped in strands around the bale. The ends of the wire strands are overlapped and then twisted or tied together to form a continuous wire strand around the bales to keep the bales together.

One method of forming a bale automatically ties the bale. The compressible material is directed into an automatic baler where it is pressed into a bale by a ram and then moved by the ram through the baler. Continuous wire strands extend automatically across the bale path at different heights on the bale, and as the bale moves through the baler, the wire strands are wrapped around the front end and sides of the bale. An automatic tying system then engages the bale and wire strands and ties the wire strands around the bale, such as by twisting together the overlapped ends of the wire strands. Examples of various automatic balers and tying methods are illustrated in U.S. Pat. Nos. 4,120,238; 4,155,296; 4,167,902, and 4,459,904. While automatic tying apparatuses have proven suitable for baling and tying compressed bales in rapid succession in certain applications, they generally require complex and expensive machinery which has to automatically manipulate and twist the wires together to form the bale.

Alternatively, certain baling applications require hand or manual tying of the wires wrapped around a bale. Hand tying devices reduce the complexities and costs associated with automatic balers and tying systems, and are often utilized to supplement automatic balers. For example, when an automatic baler malfunctions, the bales cannot be properly wrapped and tied. This creates a slowdown in bale production and will usually mean a work stoppage until the automatic baler is repaired. Repairs are often not immediately made due to the necessity of scheduling a repair person. To ensure that bale production is not altogether stopped during repair situations and, to reduce the bale slowdown, hand tying devices are used. The wire is wrapped around the bale and tied manually with such a device. Still further, the particular material being baled may dictate that hand tying is required, because of the complexities involved in trying to design an automatic tying apparatus for the material.

Various different hand tying or splicing mechanisms are commercially available and have provided a means for manually twisting and tying two wires together, such as to bind a bale. However, such devices usually require two people to operate because of the tasks of manually wrapping the wire and tying the ends of the wrapped wire. For example, the wire ends will usually be tied on the sides of the bale. Therefore, one person must wrap the wire around the bale and hold the overlapped wire ends in position while another person actually twists and ties the wire ends together. As a result, use of existing hand tyers may be relatively inefficient and expensive due to increased labor costs.

Furthermore, it may take a relatively substantial amount of time to wrap and tie a single strand of wire around a bale. For example, in the inventor's experience, it will usually require 2–4 minutes for two people to wrap and tie one strand. A single bale may require 4–6 strands. As may be appreciated, manually wrapping and tying a bale with the available hand tying devices is inefficient.

Therefore, there is a need for a method and apparatus to rapidly and adequately tie and secure a wire or other similar binding device around a bale of compressed material.

It is an objective of the present invention to provide a simple and inexpensive apparatus for assisting a person in manually tying a wire around a bale.

It is another objective of the present invention to reduce the number of people required to manually wrap and tie a bale.

It is a further objective of the present invention to provide a more efficient and cost effective means to manually tie bales.

These and other objectives will become more readily apparent from the Summary of the Invention and Detailed Description set forth hereinbelow.

SUMMARY OF THE INVENTION

The above objectives and other objectives are addressed by use of a novel and unique mounting device in combination with a hand tying device to tie a bale of compressed material. The mounting device comprises a pair of elongated members positioned generally parallel to each other and spaced from each other to form a generally planar body. One or more spacer elements are coupled between the pair of elongated members to secure the members together. A pair of legs extends from one end of the body, one leg coupled to each of said elongated members. The legs extend generally perpendicular to the body. Each of the legs includes a pointed mounting foot which depends from the leg and extends generally perpendicular to the leg and, therefore, generally parallel to the body. The mounting feet are configured to engage a generally horizontal surface of the bale to secure the body along a generally vertical side surface of the bale. That is, the mounting feet engage the top surface of a bale and preferably dig into the top surface, and thereby position the body along a side surface of the bale.

The mounting device includes stand-off elements extending from the other end of the body opposite the legs. The stand-off elements are generally perpendicular to the body and are configured for coupling to a hand tying device. To that end, the stand-off elements comprise mounting flanges which are configured for being coupled to a hand tying device, such as with bolts. The stand-off elements orient the hand tying device against the vertical side surface of the bale when the mounting device is placed on the bale. In that way, the hand tying device is secured to the side of the bale while the wire strand to be tied can be wrapped around the bale by a single person. The invention eliminates the need for a second person to maintain the wire tying device against the side of a bale while the wire is wrapped therearound. Therefore, the invention eliminates the need for having two people to efficiently tie a bale and thus reduces labor costs. Furthermore, because the hand tying device is maintained on the side of the bale, the time for wrapping a bale can be reduced from 2–4 minutes per strand to approximately 1–2 minutes, thus resulting in a substantial labor cost savings, and increasing the efficiency of the baling and tying process.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
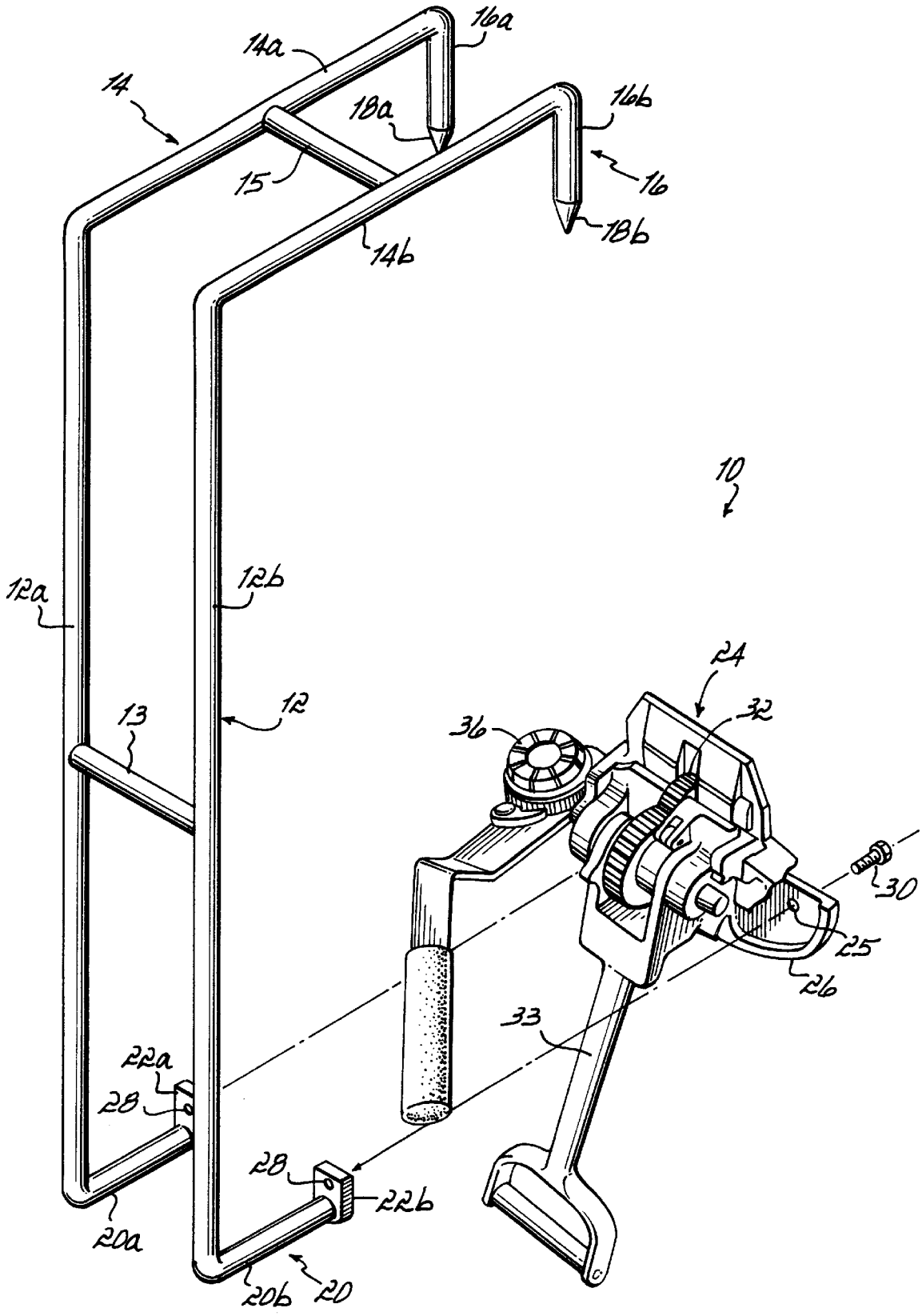
FIG. 1 is a disassembled perspective view of a mounting device consistent with the invention shown with a hand tying device.

FIG. 1 is a perspective view of the invention shown coupled with a commercially available hand tying device. One particular hand tying device suitable for use with the present invention, is the Model LK available from United States Steel. The inventive mounting device 10 comprises a pair of elongated members indicated individually as 12*a* and 12*b* in the figures. The elongated members may be made of bar stock and are oriented generally parallel to each other and laterally spaced from each other to define the generally planar body 12. A spacer element 13 is positioned between the elements 12*a* and 12*b* and is appropriately attached thereto, such as by welding. The planar body 12 is positioned to lie flat against the side of a bale when the mounting device is mounted to the bale, as discussed further hereinbelow.

Figure 3A:
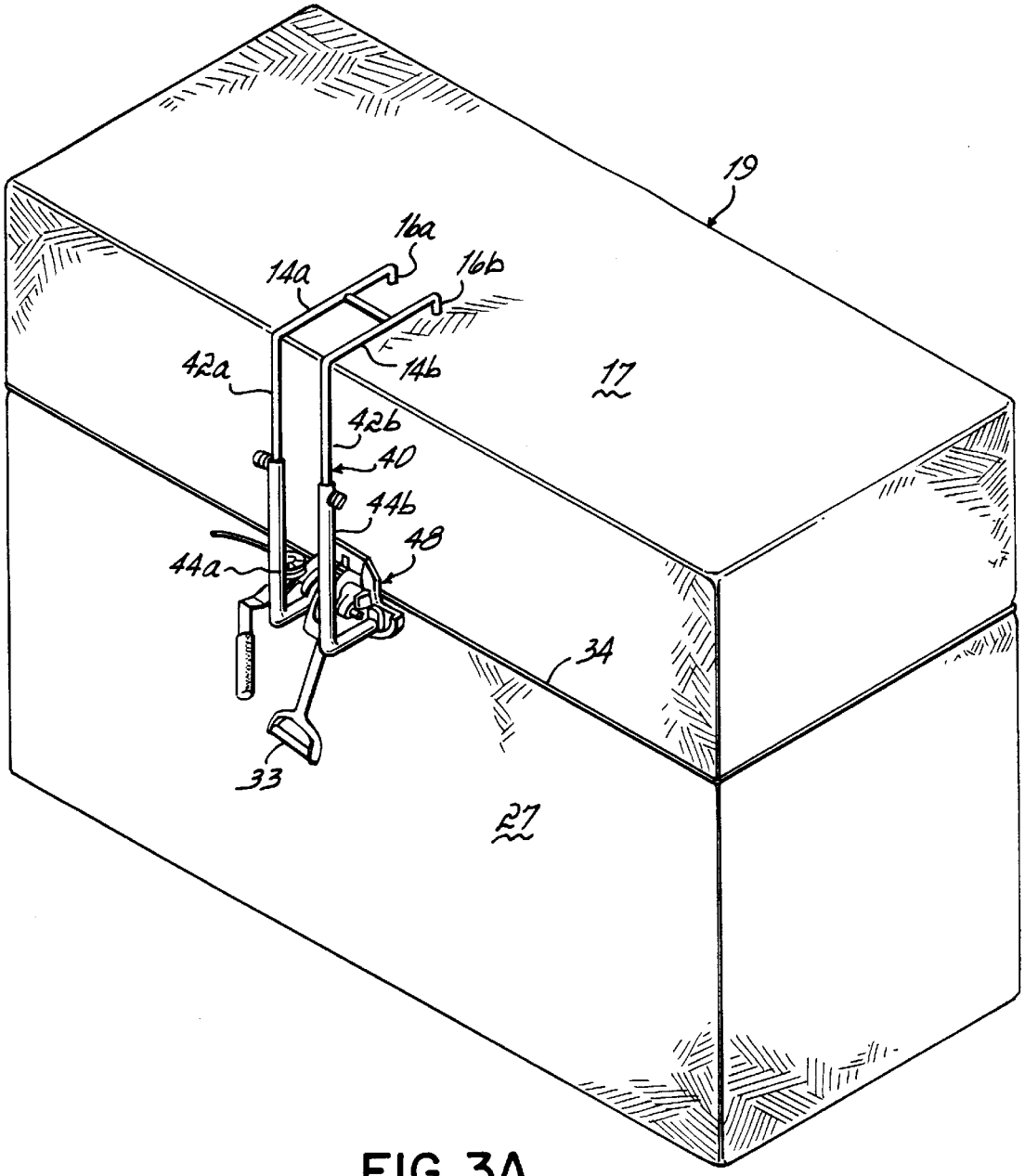
FIG. 3A is a perspective view of a bale of material being wrapped using the invention.
Figure 3B:
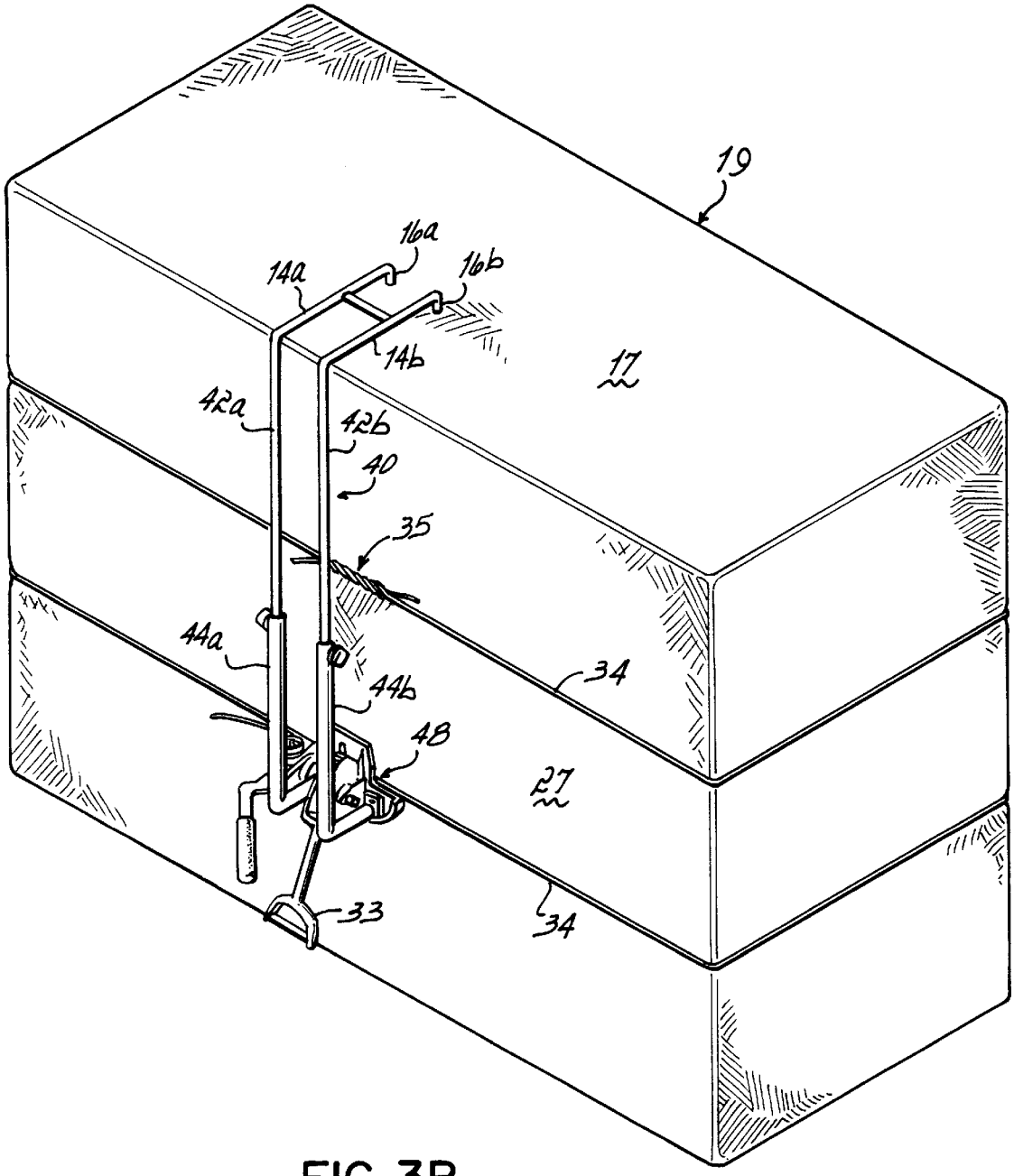
FIG. 3B is a perspective view like FIG. 3 with the invention shown in a different position.

Extending from the body are legs 14*a,* 14*b* which are coupled to the end of the body by being coupled to appropriate ends of the respective elongated members 12*a,* 12*b* such as by welding. The legs 14*a,* 14*b* may also be made of bar stock. A spacer element 15 is appropriately fastened between the legs to maintain their position, similar to the way in which the spacer element 13 maintains the position of the elongated members 12*a,* 12*b*. The legs 14*a,* 14*b* extend generally perpendicular to the body 12 and define a mounting platform 14 for the device which is positioned at the top horizontal surface of the bale when the mounting device is mounted thereto (see FIGS. 3A and 3B). Depending from each of the legs 14*a,* 14*b* is a mounting foot 16*a,* 16*b* (collectively 16). Each mounting foot 16*a,* 16*b* is configured to engage a generally horizontal surface 17 of the bale 19 to secure the mounting platform formed by the legs 14*a,* 14*b* generally adjacent to the horizontal bale surface 17. As illustrated in FIGS. 3A and 3B, when the legs 14*a,* 14*b* are positioned as such, the body 12 is operably positioned along a vertical side surface 27 of the bale 19. Each of the legs 16*a,* 16*b* preferably includes a pointed end 18*a,* 18*b*. The pointed ends 18*a,* 18*b* are operable for digging into or otherwise engaging the horizontal surface 17 of the bale for further securing the mounting device 10 to the bale. As may be appreciated, bales of compressed material are generally somewhat pliable, and thus the mounting feet 16*a,* 16*b* can be driven into the horizontal bale surface 17 to secure the mounting device 10 at a desired position on the bale. (See FIG. 3A.)

On an end of the body 12, opposite the legs 14*a,* 14*b* and mounting feet 16*a,* 16*b,* stand-off elements 20*a,* 20*b* (collectively 20) extend from the body 12, generally perpendicular thereto. In the embodiment illustrated in the figures, the stand-off elements are also formed of bar stock and are appropriately fastened to the end of the elongated elements 12*a,* 12*b,* such as by welding The stand-off elements 20*a,* 20*b* extend generally perpendicular to the body and thus when the mounting device is positioned on the bale, the stand-off elements will extend in the direction of the vertical side surface of the bale (see FIGS. 3A, 3B). The stand-off elements include mounting flanges 22*a,* 22*b,* which are configured for coupling to a hand tying device 24. The mounting flanges may be fastened or otherwise coupled to a portion of the hand tying device 24 such as by bolts 30.

For example, if a Model LK tyer is used as discussed above, appropriate fastener apertures 25 might be formed in a plate-like portion 26 of the hand tyer 24. Similar fastener apertures 28 are formed in the mounting flanges 22*a,* 22*b*. Appropriate fasteners, such as bolts 30, engage the plate-like portion 26 and mounting flanges 22*a,* 22*b* for coupling the mounting device 10 with the hand tying device 24. The stand-off elements 20*a,* 20*b* are coupled to the hand tying device 24 such that they orient the hand tying device against the vertical surface 27 of the bale for receiving overlapped ends of a strand of wire wrapped around the bale as illustrated in FIG. 3A. The hand tying device 24 will generally include a twister pinion 32, and a handle or crank 33 for turning the twister pinion to twist the wires 34 and thus form a knot 35. Hand tying device 24 might also include a tensioning structure 36 which is used to tension the wire strands 34 around the bale before it is twisted in the pinion 32. As mentioned above, any number of a variety of different commercially available hand tying devices might be utilized with the mounting device 10 of the invention. Therefore, the operation of such tying devices will differ.

The mounting device eliminates the need for a person to position and hold the hand tying device 24 against the side 27 of the bale 19, thus allowing the bale 19 to be wrapped and tied by a single person to reduce labor costs. Furthermore, utilizing the mounting device 10 of the invention in combination with the hand tying device 24, a strand of wire 34 may be wrapped and tied around the bale by a single person in 1–2 minutes, substantially less than the 2–4 minutes required even with two people to wrap and tie the bale. Accordingly, the inventive device yields an increase in efficiency and a reduction of costs in the baling process. When a wire strand 34 is wrapped around bale 17, the loose ends of the wire are brought together and overlapped. The overlapped ends are then positioned in a slot (not shown) in the twister pinion 32. Cranking handle 33 turns pinion 32 and forms knot 35 as is known in the art. (See FIG. 3B.)

Figure 2:
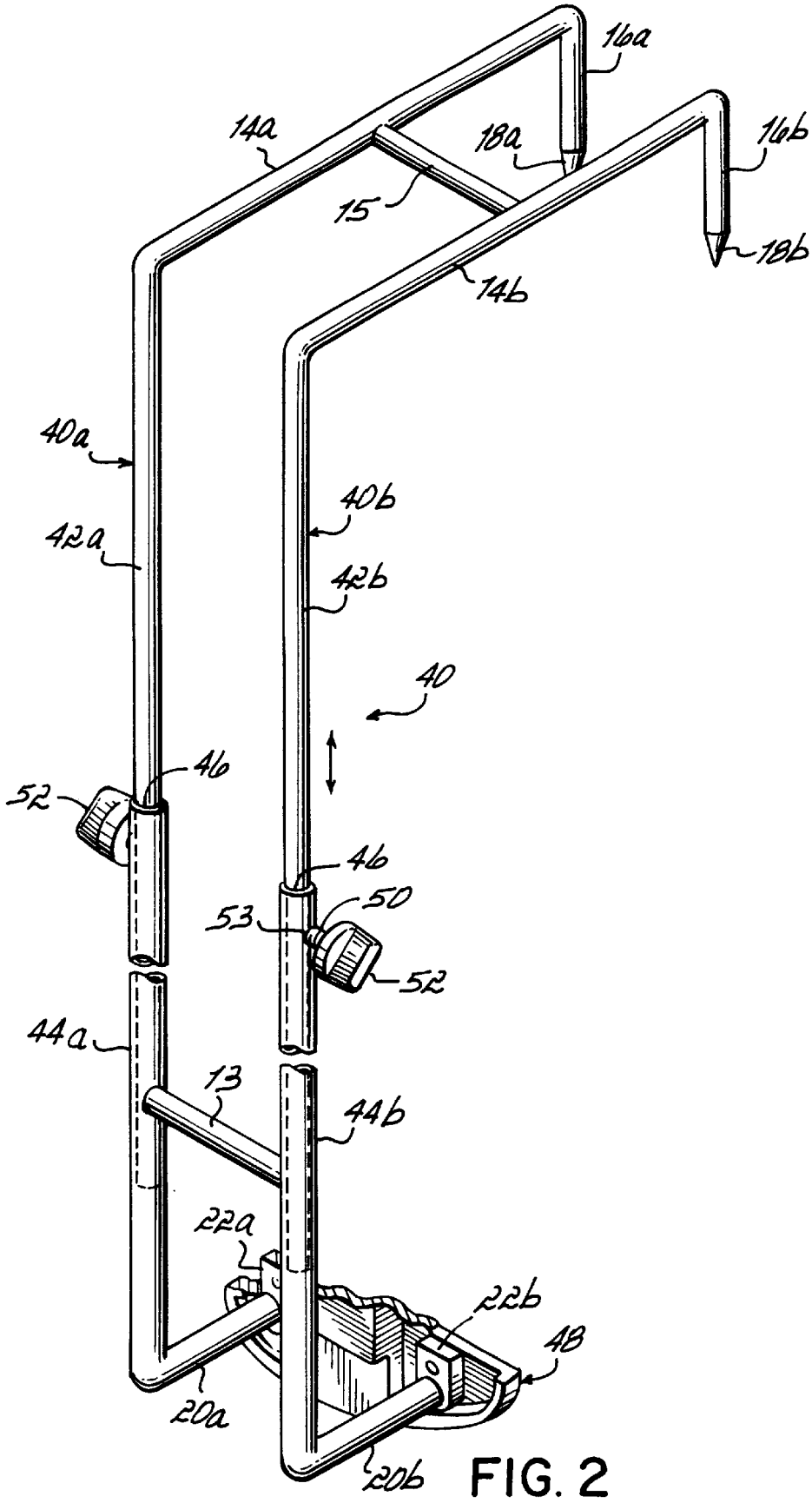
FIG. 2 is a perspective view of another embodiment of a mounting device consistent with the invention.

FIG. 2 illustrates an alternative embodiment of the invention wherein the elongated members 40*a,* 40*b* comprise first sections 42*a,* 42*b* respectively, and second sections 44*a,* 44*b,* respectively. The first and second sections, for example 42*a* and 44*a* of elongated element 40*a,* are operably coupled together for varying the length of the elongated member 40*a,* and therefore the length of the body 40. The sections 42*b* and 44*b* of the elongated element 40*b* operate in a similar fashion. In that way, the length of the body 40 of the mounting device may be varied to vary the position of the hand tying device on the side of the bale 19. One method of operably coupling the sections 42*a,* 42*b,* and 44*a,* 44*b* together is to make one of the sections, such as first section 42*a,* smaller than the other of the coupled sections such as second section 44*a*. In that way, sections 42*a,* 42*b* telescopically move within sections 44*a,* 44*b*. The sections 44*a,* 44*b* have appropriate apertures 46 formed therein to receive the respective sections 42*a,* 42*b* for telescopic coupling. As will be appreciated, other coupling might be achieved, such as by having the two sections 42*a,* 44*a* move within an intermediate element (not shown). Accordingly, the term operably coupling does not refer only to the embodiments illustrated in the Figures, but may encompass other embodiments as well. The alternative of the embodiment of the invention illustrated in FIG. 2 allows for variable positioning of the hand tying device 48 along the side surface of the bale 19 as shown in FIGS. 3A and 3B.

Turning now to FIG. 3A, the invention is illustrated for use with a commercially available hand-tying device on the side of a bale 19. The mounting device 12 is positioned for tying wire strand 34 around bale 19 at a predetermined position along the height of bale 19. When wrapping and tying a bale, it is generally necessary to wrap and tie several strands of wire 34 around the bale. To that end, as illustrated in FIG. 3B, the embodiment of the invention illustrated in FIG. 2 may be operably lengthened to tie another strand of wire on the bale vertically below the first strand of wire. The adjustable embodiment of the invention illustrated in FIG. 2 includes a locking mechanism such as a set screw 50 which is coupled to an appropriate manually manipulateable knob 52 for tightening the set screw 50 against the first sections 42*a,* 42*b* of the elongated members 40*a,* 40*b*. As illustrated in FIG. 2, the set screw 50 would extend through an appropriately formed aperture 53 and the section 44*a,* 44*b*. As will be recognized by a person of ordinary skill in the art, other locking mechanisms might be utilized consistent with the invention and the embodiment illustrated in FIG. 2.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A mounting device for use with a hand tying device to tie a bale of compressed material, comprising:

a pair of elongated members positioned generally parallel to each other to form a generally planar body;

a leg extending from an end of each elongated member of the body, each leg extending in a first direction and generally perpendicular to said body, the legs being spaced horizontally from each other to define a mounting platform to support the body;

a mounting foot depending vertically from each leg, the mounting foot configured for engaging a generally horizontal surface of a bale with which the device may be used to secure said planar body along a generally vertical surface of the bale;

at least one standoff element extending in said same first direction from the other end of at least one of said elongated members of the body opposite the leg, the standoff element being oriented generally perpendicular to said body to generally space the body away from the bale proximate said other end;

a mounting flange coupled to the standoff element, the mounting flange oriented similarly to the body and comprising apertures for aligning with a portion of a hand tying device for orienting the hand tying device against the vertical surface of the bale when the body is secured along the bale.

2. The device of claim 1 further comprising a spacer element coupled between the pair of elongated members to secure the members together.

3. The device of claim 1 wherein said foot includes a pointed end operable for engaging said horizontal surface of the bale to secure said planar body to the bale.

4. The device of claim 1 wherein said elongated members each comprise first and second sections, the sections being operably coupled together for varying the length of the members and the length of the body.

5. The device of claim 4 wherein said sections are telescopically coupled together for varying the length of the body.

6. The device of claim 1 further comprising a spacer element coupled between the legs for securing the legs together and further defining the mounting platform.

7. An assembly for use in tying a bale of compressed material, comprising:

a pair of elongated members positioned generally parallel to each other to form a generally planar body;

at least one leg extending from an end of the body, the leg extending in a first direction and generally perpendicular to said body;

a mounting foot depending from the leg, the mounting foot configured for engaging a generally horizontal surface of the bale with which the assembly may be used to secure said body along a generally vertical surface of the bale;

at least one standoff element extending in said first direction from another end of the body opposite the leg, the standoff element being generally perpendicular to said body;

a hand tying device operable for tying a wire around the bale;

the standoff element being coupled to the hand tying device for orienting the hand tying device against the vertical surface of the bale when the body is secured along the bale.

8. An assembly for use in tying a bale of compressed material, comprising:

a pair of elongated members positioned generally parallel to each other to form a generally planar body;

at least one leg extending from an end of the body, the leg extending in a first direction and generally perpendicular to said body;

a mounting foot depending from the leg, the mounting foot configured for engaging a generally horizontal surface of a bale with which the assembly may be used to secure said body along a generally vertical surface of the bale;

at least one standoff element extending in said first direction from another end of the body opposite the leg, the standoff element being generally perpendicular to said body;

a mounting flange coupled to the standoff element, the mounting flange configured for coupling to a portion of a hand tying device for orienting the hand tying device against the vertical surface of the bale when the body is secured along the bale;

said elongated members each comprising first and second sections, the sections being telescopically coupled together for varying the length of the members and the length of the body to thereby vary the position of the hand tying device along the height of a bale.

* * * * *